US012709438B2

(12) United States Patent
Ekta

(10) Patent No.: US 12,709,438 B2
(45) Date of Patent: Aug. 18, 2026

(54) PAPER BASED CORRUGATED ENVELOPE

(71) Applicant: AUM PAPER PRODUCTS PRIVATE LIMITED, Bangalore (IN)

(72) Inventor: Chandan Mahesh Ekta, Bangalore (IN)

(73) Assignee: AUM PAPER PRODUCTS PRIVATE LIMITED, Bangalore (IN)

( * ) Notice: Subject to any disclaimer, the term of this patent is extended or adjusted under 35 U.S.C. 154(b) by 78 days.

(21) Appl. No.: 18/267,702

(22) PCT Filed: Dec. 18, 2021

(86) PCT No.: PCT/IN2021/051187

§ 371 (c)(1),
(2) Date: Jun. 15, 2023

(87) PCT Pub. No.: WO2022/130415

PCT Pub. Date: Jun. 23, 2022

(65) Prior Publication Data

US 2024/0043176 A1 Feb. 8, 2024

(30) Foreign Application Priority Data

Dec. 18, 2020 (IN) ..... 202041055241

(51) Int. Cl.
*B65D 27/30* (2006.01)
*B65D 27/14* (2006.01)
(Continued)

(52) U.S. Cl.
CPC ..... *B65D 27/30* (2013.01); *B65D 27/14* (2013.01); *B65D 65/403* (2013.01); *B65D 81/03* (2013.01);
(Continued)

(58) Field of Classification Search
CPC ..... B65D 27/30; B65D 27/14; B65D 65/403; B65D 2401/55
See application file for complete search history.

(56) References Cited

U.S. PATENT DOCUMENTS 3,407,987 A 10/1968 Wilke
4,418,861 A * 12/1983 McFarland ..... B65D 77/062 229/125
(Continued)

FOREIGN PATENT DOCUMENTS

GB 2331256 A 5/1999
JP S51134277 A 11/1976
(Continued)

OTHER PUBLICATIONS

Coffin et al. "Creasing and Folding", Advances in Pulp and Paper Research, Oxford 2017, Trans. of the XVIth Fund. Res. Symp. Oxford 2017, (W. Batchelor and D. Södergerg, eds), pp. 69-136, FRC, Manchester, 2018. DOI:10.15376/frc.2017.I.69.
(Continued)

*Primary Examiner* — Derek J Battisti
(74) *Attorney, Agent, or Firm* — HAYES SOLOWAY P.C.

(57) ABSTRACT

This invention is related to a 2-ply corrugated paper-based envelope with crease lines and glue strips for primary and secondary packaging and transportation needs. The envelope comes with glue strips in single or double (for reverse logistics if required) lines. These envelopes can be enhanced with a provision for tear tape for the frustration-free opening of the package. To enhance evidence of tampering of the envelope, there is an option for perforation. The envelope can come with a numbering system all around except at the top, where tear tape can be provided for ease of opening. To help in identifying if the package has been tampered with, there is an option of printing a line along with the flap/
(Continued)

opening with special ink which turns pink in color when comes in contact with heat.

9 Claims, 5 Drawing Sheets

(51) Int. Cl.
*B65D 65/40* (2006.01)
*B65D 81/03* (2006.01)

(52) U.S. Cl.
CPC .... *B65D 2401/55* (2020.05); *B65D 2581/053* (2013.01)

(56) References Cited

U.S. PATENT DOCUMENTS

| | | | | |
|---|---|---|---|---|
| 4,559,259 | A | 12/1985 | Cetrelli | B26D 3/08 |
| 4,877,139 | A * | 10/1989 | Kim | B65D 77/32 229/238 |
| 11,713,177 | B1 * | 8/2023 | Jackson | B65D 27/38 383/205 |
| 2008/0035714 | A1 * | 2/2008 | Rasmussen | B32B 27/34 229/87.02 |
| 2012/0006818 | A1 * | 1/2012 | Fester | B65D 5/566 220/651 |
| 2014/0093705 | A1 * | 4/2014 | Shi | B65D 81/05 428/182 |
| 2017/0349323 | A1 * | 12/2017 | Yamada | B31B 50/256 |
| 2019/0322433 | A1 * | 10/2019 | Zhou | B65D 65/403 |
| 2021/0139200 | A1 * | 5/2021 | O'Hara | B65D 81/18 |
| 2022/0388750 | A1 * | 12/2022 | Boshaw | B65D 81/03 |
| 2023/0331454 | A1 * | 10/2023 | Jackson | B65D 81/03 |

FOREIGN PATENT DOCUMENTS

| | | | | |
|---|---|---|---|---|
| JP | H08133306 | A | 5/1996 | |
| JP | H9165045 | A | 6/1997 | |
| JP | 2000052460 | A | 2/2000 | |
| JP | 2002120870 | A | 4/2002 | |
| JP | 2010208310 | A | 9/2010 | |
| JP | 2012046217 | A | 3/2012 | |
| NZ | 229608 | | 5/1994 | B65D 27/30 |
| RU | 67313 | | 10/2007 | G09F 3/03 |
| WO | 2009148331 | A1 | 12/2009 | |
| WO | 2019210046 | A1 | 10/2019 | |

OTHER PUBLICATIONS

"Corrugated cardboard envelopes", https://www.bestbuyenvelopes.com/dispatch-packaging/cardboard-envelopes/corrugated-cardboard-envelopes , published Mar. 18, 2016, accessed by PCT Examiner Mar. 9, 2022, 4 pgs.

International Search Report and Written Opinion issued in PCT/IN2021/051187, dated Mar. 21, 2022, 6 pgs.

* cited by examiner

PAPER BASED CORRUGATED ENVELOPE

CROSS REFERENCE TO RELATED APPLICATION

This application is a national stage application of PCT/IN2021/051187 filed Dec. 18, 2021 which claims benefit of Indian Provisional Application No. 202041055241 filed Dec. 18, 2020, the entire disclosures of which are incorporated herein by reference.

FIELD OF INVENTION

This invention is related to 2 ply corrugated envelopes, provided with crease lines for forming packaging envelopes.

BACKGROUND OF THE INVENTION

In general, an envelope is a packing material, usually made of thin, flat material. The traditional envelopes are made out of sheets of paper cut to one of the three shapes: a rhombus, a short-arm cross, or a kite. These shapes allow the making of an envelope structure by folding the sheet sides around a central rectangular area. In this manner, a rectangle-faced enclosure is formed with an arrangement of four flaps on the reverse side.

A pocket—a format frequently employed in packing small quantities of seeds. Although in principle the flaps can be held in place by securing the topmost flap at a single point (for example with a wax seal), generally they are pasted or gummed together at the overlaps. They are most commonly used for enclosing and sending mail (letters) through a prepaid-postage postal system.

A Window envelope is another form wherein the envelopes have a hole cut in the front side that allows the paper within to be seen. They are generally arranged so that the receiving address printed on the letter is visible, saving the sender from having to duplicate the address on the envelope itself. The window is normally covered with a transparent or translucent film to protect the letter inside, as first designed by Americus F. Callahan in 1901 and patented the following year. In some cases, shortages of materials or the need to economize resulted in envelopes that had no film covering the window. One innovative process, invented in Europe about 1905, involved using hot oil to saturate the area of the envelope where the address would appear. Thus, the treated area becomes sufficiently translucent for the address to be readable. As of 2009, there are no international standards for window envelopes, but some countries, including Germany and the United Kingdom, have national standards.

Many articles and inventions are addressing the design of envelopes and techniques to form a variety of provisions to incorporate a safe package.

In U.S. Pat. No. 4,559,259, packing laminations, those of which are intended to be converted into packing containers, are often provided with crease lines to facilitate folding and shaping. At the places where crease lines cross each other, a multiple folding of the laminated material takes place. On transporting the same into packing containers, among other things, develops small cracks in the different material layers, thus leading to the tightness of the packing container which is put into jeopardy. In accordance with our invention, a packing laminate is proposed to overcome these difficulties by providing the laminate with specially designed auxiliary crease lines 6 in the region of the laminate, wherein the crease lines 7 cross each other or meet, replacing the main folding crease line 8, thereby guiding the folding of crease lines 7. The auxiliary crease lines 6 are situated at such distance from the main folding line 8, so that the main folding line 8 would not be affected, i.e. to precisely state that the main folding line 8 would not coincide in any part with the auxiliary crease lines 6. The auxiliary crease lines 6 would merely be situated on either side of the main folding line 8 in such a manner that the auxiliary crease lines 6 take up and guide the crease formation or 'wrinkling' which normally arises in the inner laminate layer in the main folding line 8 itself. Moreover, the conventional envelopes are made with three or more layers resulting in a higher carbon footprint.

An article citation, vide: D. Coffi n and M. Nygårds. Creasing and folding. In Advances in Pulp and Paper Research, Oxford 2017, Trans. of the XVIth Fund. Res. Syrup. Oxford, 2017, (W. Batchelor and D. Söderberg, eds), pp 69-136, FRC, Manchester, 2018 DOI: 10.15376/frc.2017.1.69 shows how to produce a paper respective to creasing and folding under a wide range of tooling geometries, and more techniques to add values to form an envelope.

However, there is a need to improve the envelope creation with a technique that improves the logistic services most comfortably, to the end-users of various sectors like e-marketing, courier services, merchants could avail the easy packaging thereby eliminating the need for subsequent packing in terms of consuming more packing materials. And the technique promotes significant economic value in the market apart from promoting an eco-friendly atmosphere in the environment by satisfying the user by providing comfortable and cost-effective quality.

OBJECT OF THE INVENTION

The object of the invention is to provide an co-friendly, tamper-proof paper-based envelope, which can provide a cushioning effect which offers protection against mechanical shocks. This envelope is mainly designed for emerging e-commerce packaging needs for quick sealing at the packing stations.

SUMMARY

This invention is related to a 2-ply corrugated paper-based envelope with crease lines and glue strips for primary and secondary packaging and transportation needs.

The envelope comes with glue strips in single or double (for reverse logistics if required) lines. These envelopes can be enhanced with a provision for tear tape for the frustration-free opening of the package. To enhance evidence of tampering of the envelope, there is an option for perforation. The envelope can come with a numbering system all around except at the top, where tear tape can be provided for ease of opening. To help in identifying if the package has been tampered with, there is an option of printing a line along with the flap/opening with special link which turns pink in color when comes in contact with heat.

DETAILED DESCRIPTION OF THE DRAWINGS

FIG. 1 illustrates the 2 ply corrugated paper in unfolded condition before forming an envelope as per one of the embodiments in the invention.

| Part Number | Part Name |
|---|---|
| 1 | Glue strip |
| 2 | Plain or top fold |
| 3 | Tear strip |
| 4 | Straight or serrated side |
| 5 | Corrugated lines |

DETAILED DESCRIPTION OF THE INVENTION

The present invention addresses the replacement of bubble-padded mailers with eco-friendly 2 PLY corrugated envelopes, to ensure the safety of the products packed and handled during logistics operations. Wherein, the present envelope is made with 2 layers of papers more sustainable by lesser consumption of paper, elimination of plastic film and hence lower carbon footprint.

Figure 1:
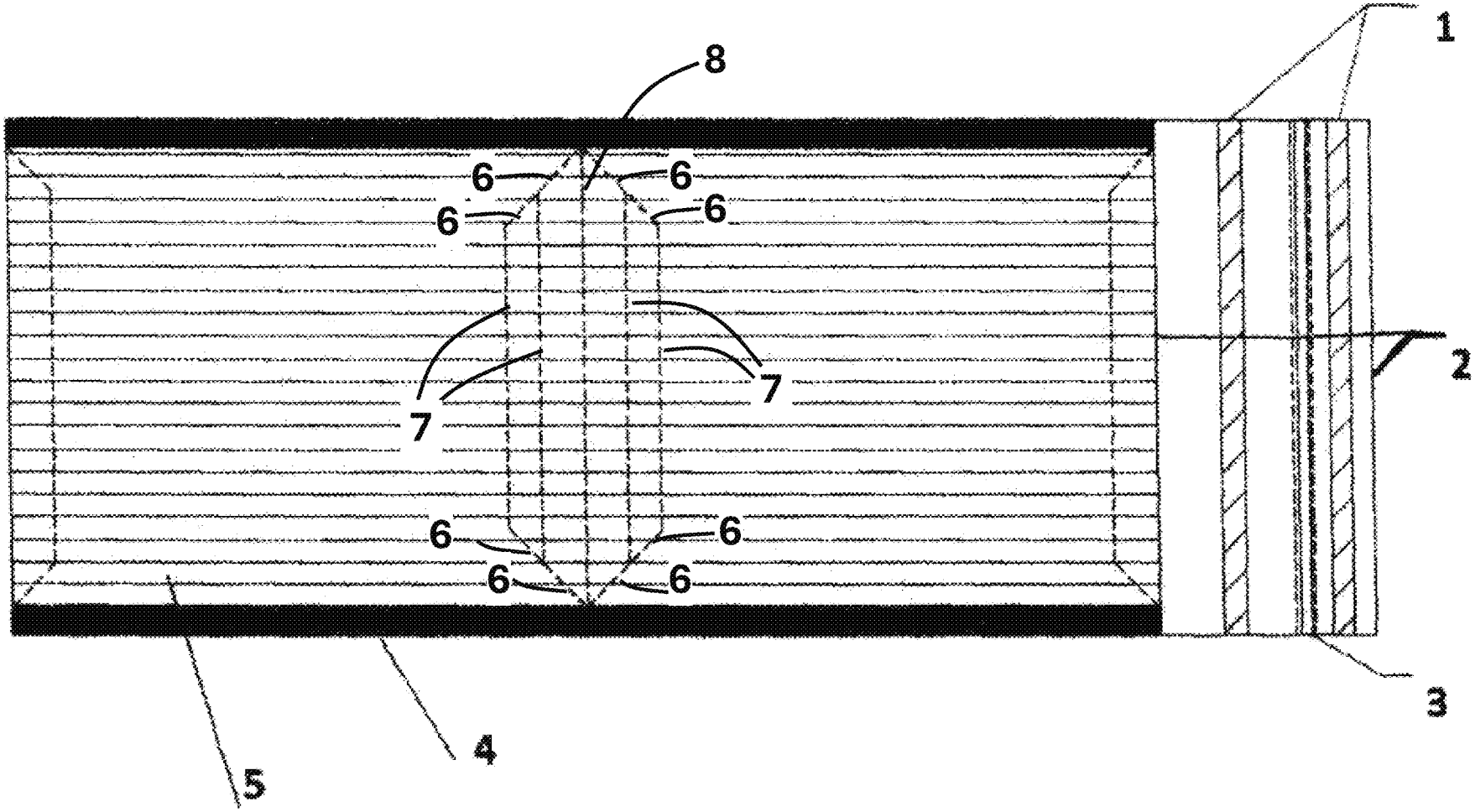
Figure 2:
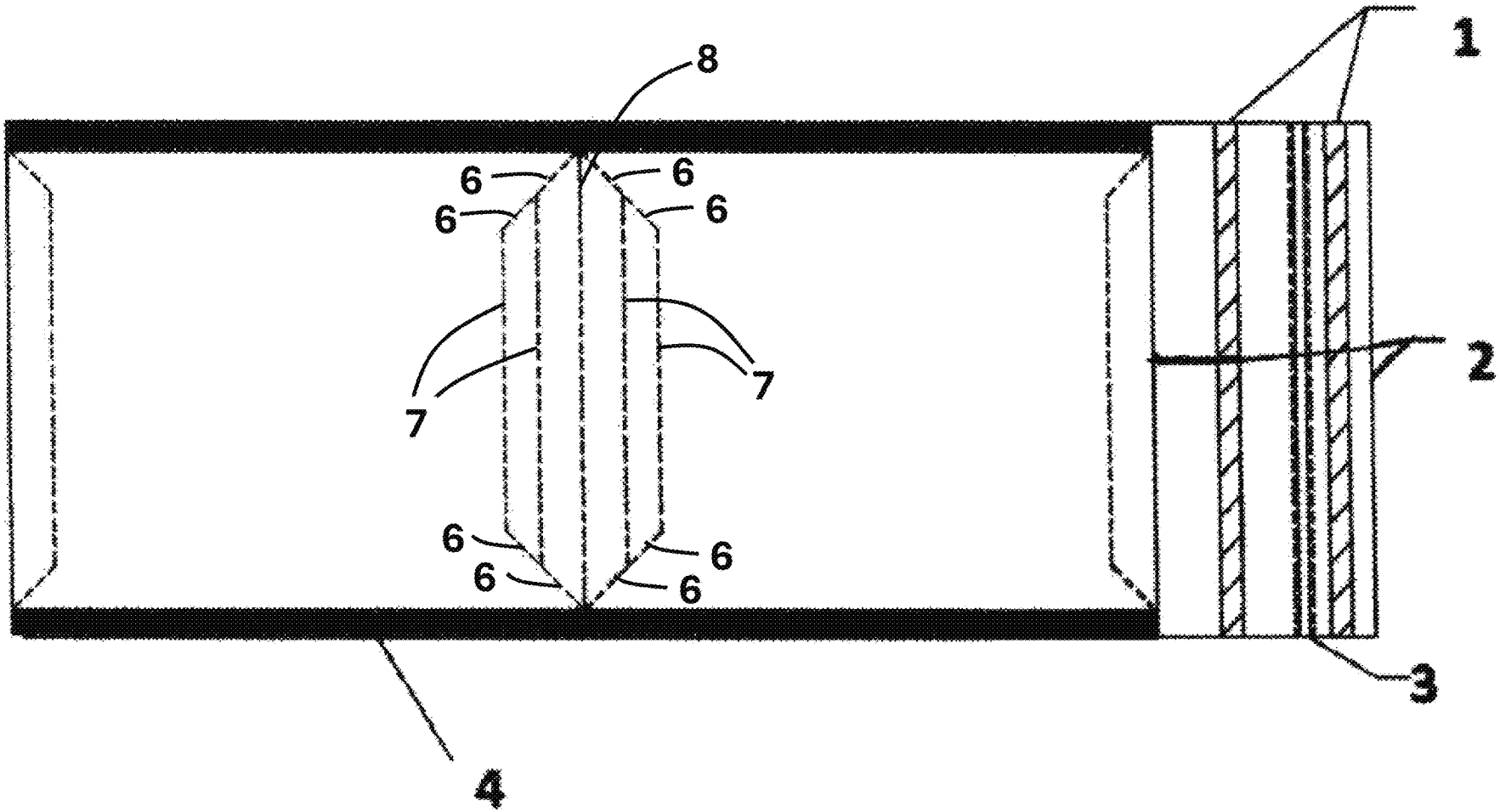
FIG. 2 illustrates the envelope without corrugated lines.
Figure 3:
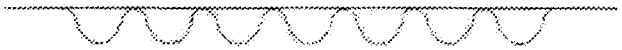
FIG. 3 illustrates the side view of the envelope having an 'M' flute profile.
Figure 4:
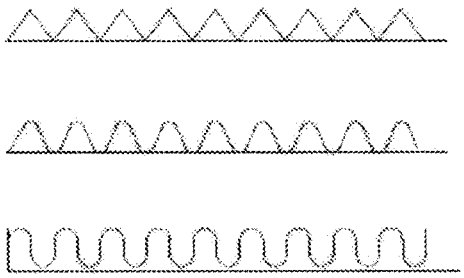
FIG. 4 illustrates the pluralities of flute profiles.
Figure 5:
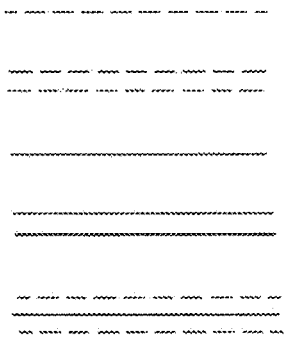
FIG. 5 illustrates the pluralities of creasing lines.
Figure 6:
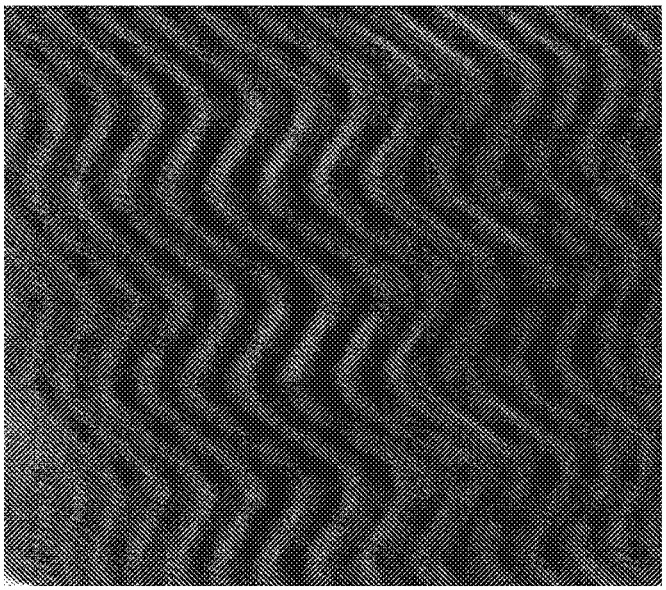
FIG. 6 illustrates the rippled corrugation.

The main embodiments of the invention are as under:— a) The first embodiment is that an envelope with embedded corrugations could be of any flute type like U, V, UV, as shown in FIG. 4 and or with rippled effect as in FIG. 6 either singularly or in combination with flute height, varying from several millimetres. The flute height can vary from 0.25 mm to 6 mm depending on the protection/cushion needed to offer variable strength, to ensure safety and functional performance.

b) That the envelope is designed to have multiple crease lines, which can be designed vertically, horizontally, or diagonally to ensure multiple products, where various sizes can be packed using a single size of envelope. The crease lines can be of varying patterns as shown in FIG. 5.

c) An envelope may be included with or without glue strips for sealing, depending on the need for packing. The envelopes can be provisioned with single or dual glue strips to ensure tamper-proof sealing. The main use of the dual glue strip is at the time of reverse logistics. In case the goods or product has to be returned by the customer or user, the same envelope facilitates the packing and sealing of the goods. This helps in eliminating the requirement of additional packing material and also ensures tamper-proof sealing.

d) The envelope could also be provisioned with or without tear tape or tear strip, to ensure frustration-free unpacking without damaging the envelope.

e) It is a 2-ply corrugated paper-based envelope with a numbering system all around except at the top where tear tape can be provided for ease of opening resulting in additional high tamper-proof packaging solution.

f) The envelope can come with a perforation, which acts as evidence in case the package is tampered with. Perforation patterns can be designed as per the need and requirements of the customers.

g) The envelopes can be produced with provisions of special link that changes its color with heat to ensure the detection of tampering. (example: a hot air blower or the like). This is an additional feature that may or may not be a part of the envelope depending on user preference.

h) The opening side of the envelope which does not have a flap can be provided with or without a top fold inside that enhances the safety feature for packers by avoiding hand cuts. The top seating area can be provided with corrugation for additional cushion.

i) The main embodiment in the invention is that the provision of the crease line or bend mark as shown in FIG. 1 is made, which enables the precise folding of the fluted packaging material, wherein, the crease lines could be a single or multiple, horizontal, vertical or diagonal depending on the requirement.

j) The Crease lines can be of different patterns as explained in FIG. 5. The pluralities of crease lines are shown where perforated single creasing line, double creasing line, without perforation a continuous double creasing lines, triple creasing tines are also shown.

Example 1

Online purchasing, and hence e-commerce packaging and use, have grown steadily in recent years, and so has their environmental impact. Plastic Packaging has not only burdened the eco system, but it also represents a significant cost in the current supply system. Sustainable e-com solution is the need of hour.

Echoing this need, we are introducing 2 Ply Expandable Corrugated Envelope. This product could also be an eco-friendly solution for poly bubble mailer, T-folders and Plus folders. The efficiency of any E-com packaging lies on its ability to protect the product inside it. 2 Ply Expandable Corrugated Envelops challenges the conventional packaging and are not only cost efficient but environmentally friendly.

This envelope is made by 2 ply corrugated sheet formed into an envelope. It consists of single face roll where in the flute height may vary from 0.25 mm to 6 mm depending on application method. The flute type can be decided depending on the desired flat crush and edge crush values.

This product is designed to have multiple crease lines that adds to flexibility and allows several SKUs to fit in one package without the need of additional voids to ensure safety of the product. The tear strip helps with the ease of opening the package and the perforation which may be present helps in evidence of tampering.

The envelope has a flap with hot-melt glue on top for quick closure and thereby saving time at pack stations. This also means that we can avoid the use of Bopp Tapes or any other additional tapes. These can be made with perforation line and tear tape to ensure frustration free packaging. An additional, glue strip may be provided if one intends to reuse the same packaging for returns.

The envelope can be made with water resistant coating on the outside to ensure superior performance in high humid regions and monsoon season.

The envelope also comes with a features which enables the customer to identify if the product has been tampered with. A special ink is put across the flap of the envelope which, when comes in contact with heat turns pink in color, thus identifying tampering.

The E-Commerce business in recent times has increased manifold and the segment is engaged in procuring and repacking materials for onward shipment which involves additional time, labour, material and cost. The present invention is directed to address issues relating to the packing of goods by E-Commerce and other allied vendors.

Futuristically, the vendors to the E-Commerce business would be encouraged to use the eco-friendly envelopes as primary packaging material for select goods and such consignments received at the fulfilment center would be directly shipped to the customers, which would result in enormous savings with respect to packaging material, labour, time and thus the overall cost.

The following features are the main embodiments discussed in the above paragraphs.

1. Made from renewable material "Paper" which means easy recyclability or biodegradation if ended up at landfill. In case of poly bubble mailer the resource is non renewable.
2. A 2 PLY corrugated paper-based envelope, sans plastic, has been developed for logistics operation to ensure the safety of goods during transit.
3. The envelope described in FIG. 1 can be produced in different strengths by using 2-ply corrugated paper with varying GSM between 30-240.
4. The envelope discussed in FIG. 1 above will be provisioned with Crease line or Bend Mark to facilitate ease of folding.
5. The envelope discussed in FIG. 1 can be provisioned with single or multiple crease lines or bend marks.
6. The envelopes discussed in FIG. 1 can be provisioned with crease lines or bend marks vertically, horizontally, diagonally, or in any combination.
7. The envelope described in FIG. 1 would be provisioned with embedded corrugations in flute height varying from 0.25 mm to 6 mm. The flute type can be either U, V, UV, or rippled corrugated profiles either singly or in combination to offer shock barrier features and thus ensure the safety of goods packaging and offers protection against mechanical or transit shocks provisioned with ease of sealing for the emerging E-commerce market at Lower carbon footprint.
8. The envelope described in FIG. 1 has been provisioned with or without glue strip. The glue strip ensures ease of tamper-proof sealing.
9. The envelope described in FIG. 1 is provisioned with a second and glue strip to ensure ease of packing and sealing during reverse logistics.
10. The envelopes are provisioned with Tear Tapes to ensure frustration-free unpacking without causing any damage to the envelope.
11. The pitch and the profile height of the corrugations vary between 0.25 mm-6 mm to produce envelopes of varying strengths which could optimally be used depending on the material to be packaged and the extent of safety desired.
12. The envelopes described in FIG. 1 could be used as primary packaging material in select goods which results in an overall reduction in the use of packaging material and hence more eco-sustainable.
13. The opening side of the envelope which does not have a flap can be provided with or without a top fold inside that enhances the safety feature for packers by avoiding hand cots.
14. Saves Transportation and Warehouse space and cost: The surface area of envelopes much lesser, also there is no void space and hence the space occupied during storage and transportation is much lesser.

The principles, preferred embodiment, and mode of operation of the present invention have been described in the foregoing specification. However, the invention which is intended to be protected is not to be construed as limited to the particular embodiment disclosed. The embodiment into be regarded as illustrative rather than restrictive. Variations and changes may be made by others without departing from the spirit of the present invention. Accordingly, it is expressly intended that all such variations and changes Which fall within the spirit and scope of the present invention as mentioned in the specification.

The invention claimed is:

1. A 2-ply paper expandable corrugated envelope for product packaging having embedded corrugations, the 2-ply paper corrugated envelope comprising: a body of the envelope formed from a 2-ply corrugated paper, the corrugated paper having flute profiles to provide a cushioning effect to a product in the envelope; a flap area of the envelope connected to the body on one side of the body; at least one self-sealing glue strip positioned on the flap area of the envelope for providing tamper-proof sealing of the flap area to the body portion; wherein the flute profiles of the corrugated paper extend along the body in a direction perpendicular to the flap area and the at least one self-sealing glue strip, and wherein the flute profiles have flute heights ranging from 0.25 mm to 6 mm; a main folding line disposed along a center line of the body of the envelope; at least four crease lines positioned proximate to the main folding line, wherein at least two crease lines of the at least four crease lines are positioned on either side of the main folding line, wherein the at least four crease lines are parallel to one another and parallel to the main folding line, and are positioned in a direction perpendicular to the flute profiles of the corrugated paper, wherein the at least four crease lines enable precise folding of the body and allow the body to be expandable or flexible to pack multiple stock-keeping units in one size of the envelope; a plurality of auxiliary crease lines formed in the body of the envelope on either side of the main crease line, wherein at least two of the at least four crease lines cross each other or meet via the plurality of auxiliary crease lines positioned diagonally relative to the at least four crease lines; wherein the envelope is produced in different strengths by using 2-ply corrugated paper with varying grams per square meter (GSM) between 30-240; and wherein the envelope lacks plastic film.

2. The 2-ply paper expandable corrugated envelope as claimed in claim 1, wherein the flap area is with a top fold.

3. The 2-ply paper expandable corrugated envelope as claimed in claim 1, wherein the flap area is without corrugations thereby providing ease of packing.

4. The 2-ply paper expandable corrugated envelope as claimed in claim 1, wherein the flap area is with corrugation thereby providing additional protection.

5. The 2-ply paper expandable corrugated envelope as claimed in claim 1, further comprising ink put across the flap area of the envelope for providing identification of tampering by contacting ink with heat to thereby cause color changes.

6. The 2-ply paper expandable corrugated envelope as claimed in claim 1, further comprising at least one perforation in the envelope to act as evidence of tampering with the envelope or easy tearing.

7. The 2-ply paper expandable corrugated envelope as claimed in claim 1, wherein flute profiles further comprise at least one of: a U flute profile, a V flute profile, a UV flute profile, or a rippled flute profile.

8. The 2-ply paper expandable corrugated envelope as claimed in claim 1, wherein the at least one self-sealing glue strip further comprises at least two self-sealing glue strips.

9. The 2-ply paper expandable corrugated envelope as claimed in claim 8, wherein further comprising at least one tear strip positioned between the at least two self-sealing glue strips.

* * * * *